US009709066B2

(12) United States Patent
Yuan et al.

(10) Patent No.: US 9,709,066 B2
(45) Date of Patent: Jul. 18, 2017

(54) VENTILATING FAN

(75) Inventors: Hongjian Yuan, Guangdong (CN); Guangmin Zeng, Guangdong (CN); Liang Tian, Guangdong (CN); Yasuhiro Suzuki, Guangdong (CN)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 737 days.

(21) Appl. No.: 14/000,755

(22) PCT Filed: Mar. 23, 2012

(86) PCT No.: PCT/CN2012/072908

§ 371 (c)(1),
(2), (4) Date: Oct. 28, 2013

(87) PCT Pub. No.: WO2012/130100

PCT Pub. Date: Oct. 4, 2012

(65) Prior Publication Data

US 2014/0037478 A1 Feb. 6, 2014

(30) Foreign Application Priority Data

Mar. 31, 2011 (CN) ..... 2011 1 0089528

(51) Int. Cl.
*F04D 25/08* (2006.01)
*F04D 29/42* (2006.01)
(Continued)

(52) U.S. Cl.
CPC ..... *F04D 25/06* (2013.01); *F04D 25/08* (2013.01); *F04D 25/12* (2013.01); *F04D 29/4226* (2013.01); *F04D 29/4246* (2013.01)

(58) Field of Classification Search
CPC .. F04D 29/4226; F04D 29/422; F04D 29/442; F04D 29/462; F04D 29/464;
(Continued)

(56) References Cited

U.S. PATENT DOCUMENTS 2,710,573 A * 6/1955 Marker ..... F24F 13/20 415/206
3,483,309 A * 12/1969 Garcia ..... H01R 13/5804 174/665
(Continued)

FOREIGN PATENT DOCUMENTS

CN 2481885 Y 3/2002
CN 2811638 Y 8/2006
(Continued)

OTHER PUBLICATIONS

Taiwan Office Action with translation issued in related Taiwan Application No. 101111316, dated Aug. 14, 2014.
(Continued)

*Primary Examiner* — Nathan Zollinger
(74) *Attorney, Agent, or Firm* — RatnerPrestia

(57) ABSTRACT

A ventilating fan including a ventilating fan body provided with a motor, a frame having ventilating air outlets, and fan blades, an adapter and an electric element box. The ventilating air outlets include a top air outlet provided on a top face of the frame of the ventilating fan and a side air outlet provided on a side face of the frame of the ventilating fan which are communicated with each other. The adapter is provided with a raised structure adapted to the ventilating air outlet. With this structure, the height of the ventilating fan is reduced while air volume is ensured, so that the ventilating fan is adapted to be mounted onto various ceilings, and the cost can be saved while mounting of the adapter is simplified.

5 Claims, 7 Drawing Sheets

(51) Int. Cl.
*F04D 25/06* (2006.01)
*F04D 25/12* (2006.01)

(58) Field of Classification Search
CPC ..... F04D 29/4246; F04D 25/08; F04D 25/10; F04D 25/06; F04D 25/12; F24F 7/007; F24F 7/08; F24F 13/14; F24F 2007/001
USPC ..... 417/423.14; 415/203, 204, 206, 212.1, 415/214.1, 213.1; 454/237, 339
See application file for complete search history.

(56) References Cited

U.S. PATENT DOCUMENTS 3,817,160 A * 6/1974 Searcy ..... F24F 9/00 239/598
4,867,640 A * 9/1989 Penlesky ..... F04D 29/626 415/204
5,294,224 A * 3/1994 Kent ..... F16B 37/041 411/174
6,468,034 B1 * 10/2002 Garrison ..... F04D 29/4226 415/200
2006/0078424 A1 * 4/2006 Lee ..... F04D 29/424 415/206

FOREIGN PATENT DOCUMENTS

| | | | | |
|---|---|---|---|---|
| CN | 201347873 | Y | | 11/2009 |
| CN | 102192167 | A | | 9/2011 |
| JP | 09250787 | A | * | 9/1997 |
| JP | 2006046170 | A | | 2/2006 |
| JP | 2011226292 | A | | 11/2011 |
| TW | M322479 | | | 11/2007 |
| TW | M248820 | | | 11/2008 |
| TW | M344460 | | | 11/2008 |

OTHER PUBLICATIONS

International Search Report for International Application No. PCT/CN2012/072908, dated May 3, 2012.
Written Opinion for International Application No. PCT/CN2012/072908, dated Apr. 25, 2012.

* cited by examiner

10

10

VENTILATING FAN

FIELD OF THE INVENTION

The present disclosure relates to a ventilating fan, and in particular, to a thin-type ventilating fan mounted on an indoor ceiling.

DESCRIPTION OF THE RELATED ART

FIG. 1 is a schematic view of a conventional ventilating fan in the prior art. A ventilating fan 10 comprises a ventilating fan body provided with a motor, a frame 11, fan blades and the like, an adapter 13 fixed on the frame 11 by an engaging member 12, and an electric element box 14 provided on the top surface of the frame 11. The frame 11 is provided at a side thereof with a ventilating air outlet 15. The end of the adapter 13 connected with the ventilating air outlet 15 is a fixing section 16, and the other end connected with a conduit is a tail portion 17. Air inside a room and air outside the room can be exchanged by means of the fixing section 16 and the tail portion 17 of the adapter 13.

In the prior art as above, the ventilating air outlet 15 is provided at a side of the frame 11 of the ventilating fan. In order to ensure an appropriate amount of air flow, the ventilating air outlet 15 must be configured to have a larger size. A ceiling is located between the ventilating air outlet 15 and a flange 19. Therefore, in order to prevent interference between the adapter 13 mounted on the ventilating air outlet 15 and the ceiling, the lowest point of the ventilating air outlet 15 should be separated from the flange 19 by a certain distance. Thus, the ventilating fan is required to have a greater thickness. In practice, the distances between mounted ceilings and the roof are different. In a case where the thickness of the ventilating fan is great and the distance between the indoor ceiling and the roof is short, the conventional ventilating fan cannot be mounted.

Further, in the above prior art, since an engaging member should be separately provided to be connected with the adapter, an additional new mould has to be made for the engaging member, and additional processes, such as butt weld and dusting, are needed, which leads to a higher cost of the product. Furthermore, extra working time is required for fixing the engaging member to the frame of the ventilating fan.

SUMMARY

Accordingly, it is desirable to provide a novel thin-type ventilating fan where the thickness of the ventilating fan is reduced while an appropriate amount of air flow is ensured.

In order to achieve the above object, the ventilating fan according to the present disclosure comprises a ventilating fan body provided with a motor, a frame having ventilating air outlet and fan blades, an adapter and an electric element box. The ventilating air outlet comprises a top air outlet provided on a top face of the frame of the ventilating fan and a side air outlet provided on a side face of the frame of the ventilating fan which are communicated with each other, and the adapter is provided with a raised structure adapted to the ventilating air outlet.

The raised structure is configured to be a structure that is formed by enclosing the top air outlet by an upper portion of a fixing section of the adapter and is gradually inclined upward, and the height of the raised structure is less than or equal to the height of the electric element box.

The raised structure is made of resin material.

An engaging structure integrally formed with the frame and engaged with the adapter is provided at a side of the top air outlet closer to the electric element box.

The engaging structure is a bending piece provided at a side of the top air outlet closer to the electric element box and engaged with the adapter, and the upper end of the bending piece is provided with a first oblique face and the lower end of the bending piece is provided with a first vertical face perpendicular to the frame.

An upper portion of a fixing section of the adapter is provided at a ventilating air-passageway side of the raised structure thereof with a structure, the upper end of which is provided with a second oblique face and the lower end of which is provided with a second vertical face perpendicular to the frame.

The top face of the frame is provided with a reinforcement rib.

The fixing section of the adapter has a shape adapted for mounting the frame, and comprises a horizontal portion enclosing the periphery of the top air outlet and a vertical portion enclosing the periphery of the side air outlet, and the lower end of the vertical portion is provided with protrusion pieces which are inserted into a flange of the frame and the upper portion of the vertical portion is provided with a mounting portion configured to fix the fixing section of the adapter to the frame.

The advantage of the present disclosure is that the height of the ventilating fan is reduced while ensuring an air volume, so that the ventilating fan is adapted to be mounted onto various ceilings, and the cost can be lowered while simplifying mounting of the adapter.

DETAILED DESCRIPTION

Figure 1:
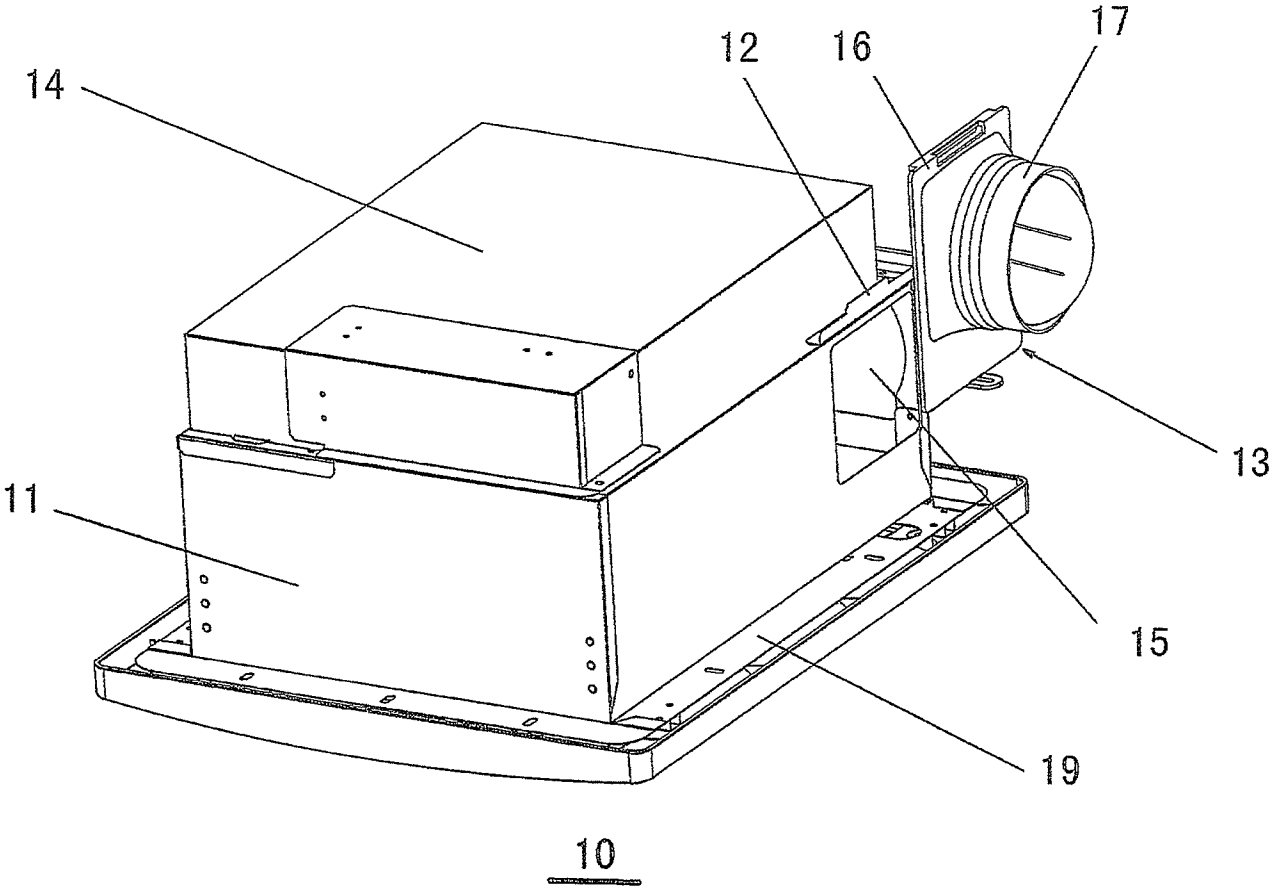
FIG. 1 is a schematic view of the prior art.
Figure 2:
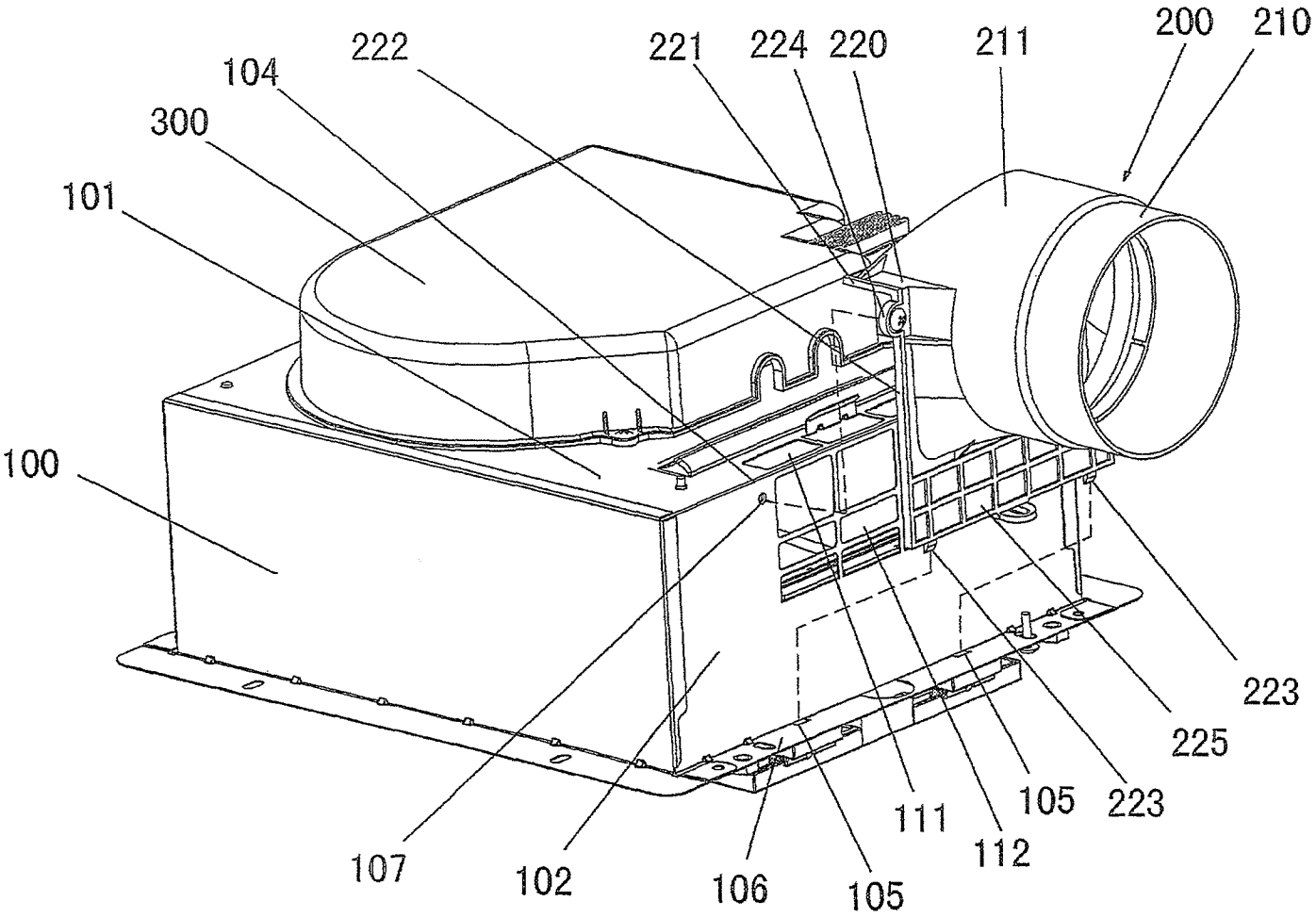
FIG. 2 is a general schematic view of the present disclosure.
Figure 3:
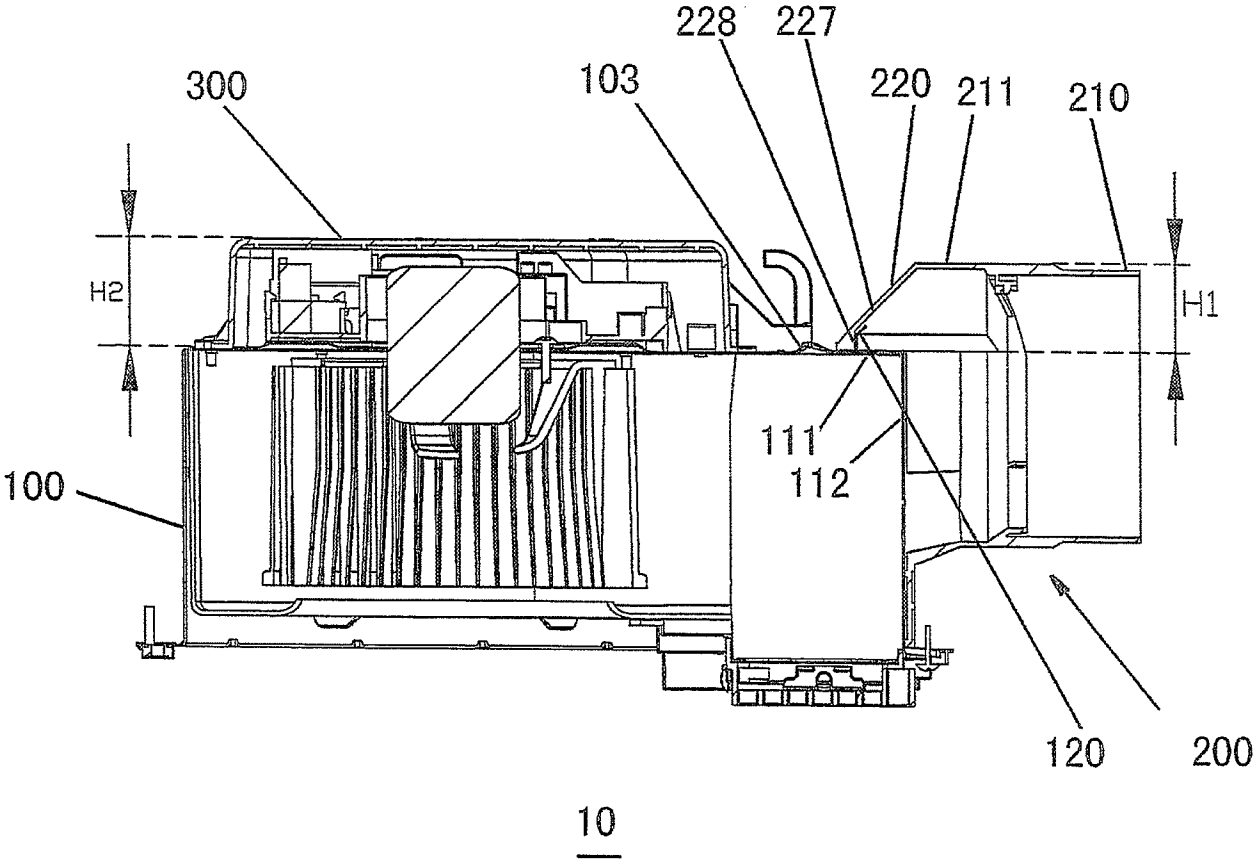
FIG. 3 is a schematic view, in cross-section, of the ventilating adapter according to the present disclosure.

FIG. 2 is a general schematic view of the present disclosure. FIG. 3 is a schematic view, in cross-section, of a ventilating adapter according to the present disclosure. As shown in Figs., the ventilating fan 10 comprises a ventilating fan body provided with a motor, a frame 100 having ventilating air outlet 110, fan blades, and like, an adapter 200 and an electric element box 300.

Figure 4:
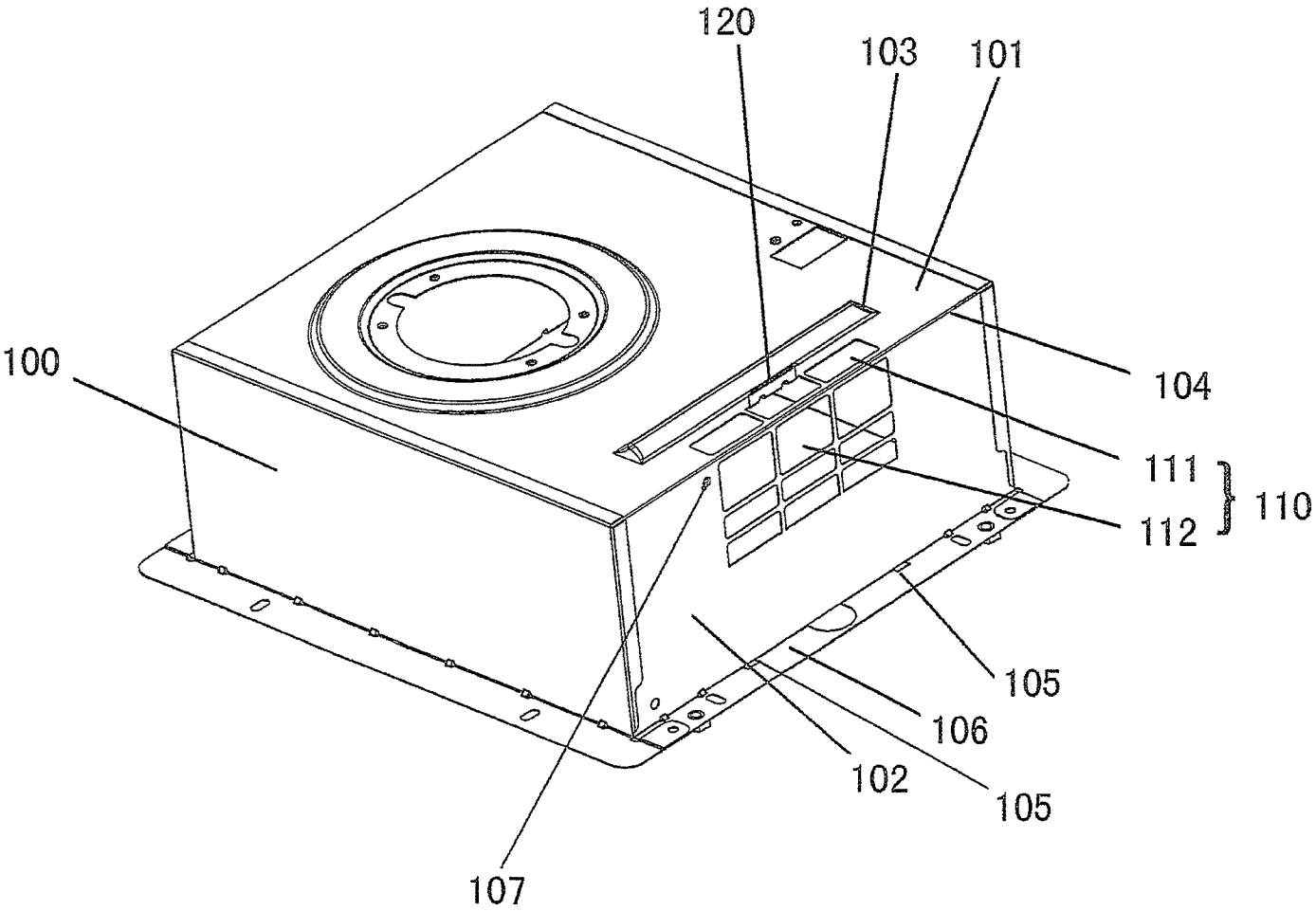
FIG. 4 is a schematic view of the ventilating air outlet according to the present disclosure.
Figure 5A:
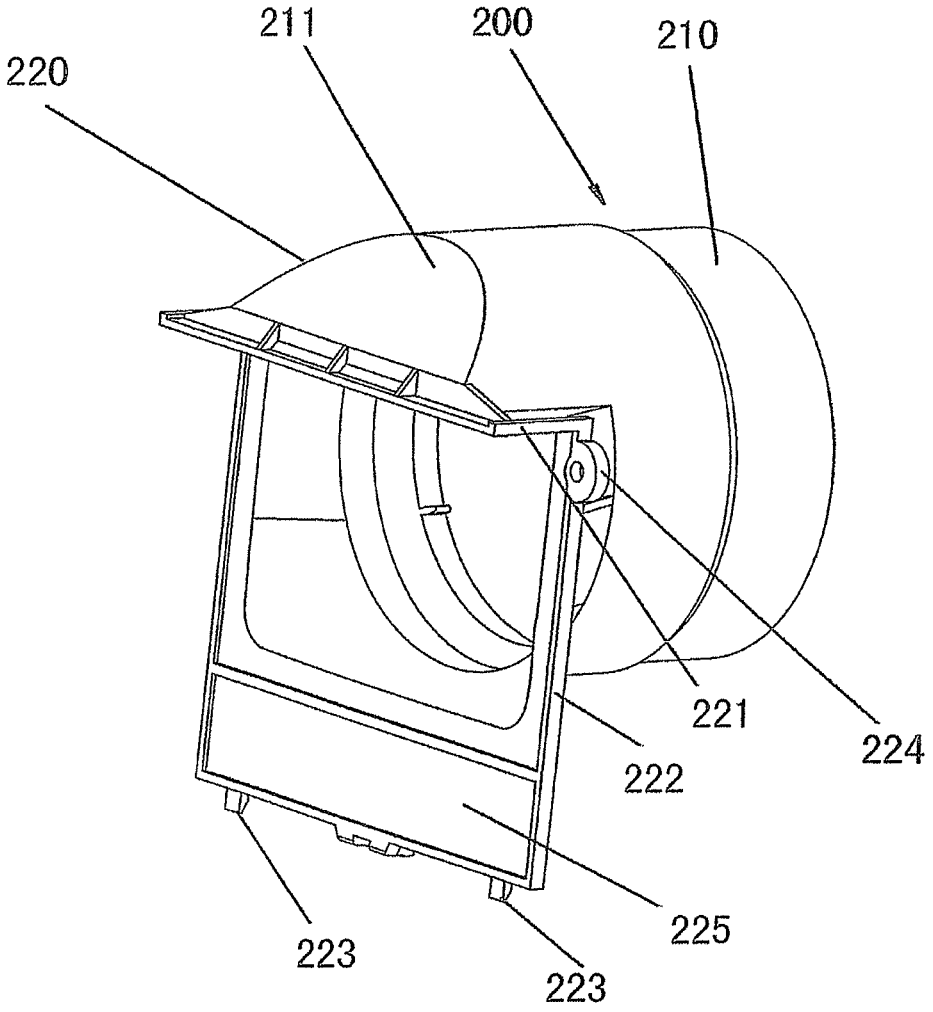
FIGS. 5A and 5B are perspective views of the ventilating adapter according to the present disclosure, seen from two different angles of view.
Figure 5B:
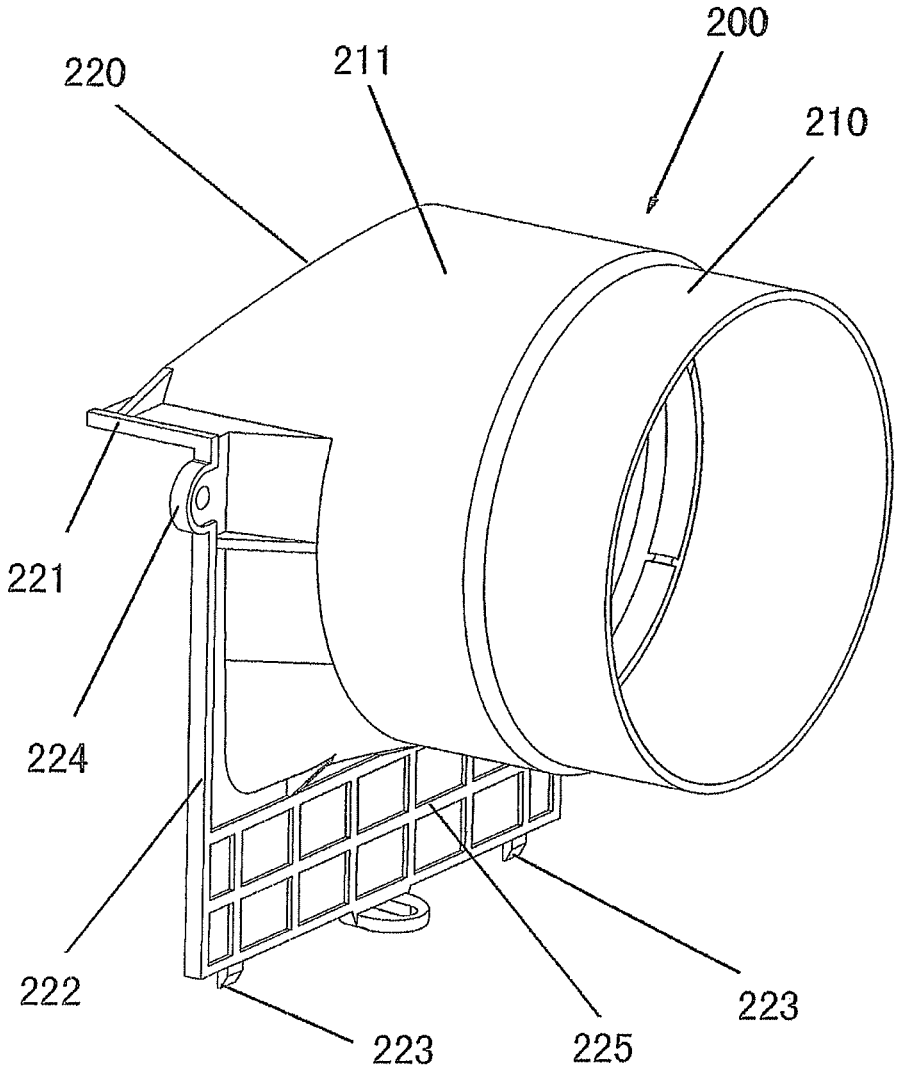

FIG. 4 is a schematic view of a ventilating air outlet according to the present disclosure. FIGS. 5A and 5B are schematic perspective views of the ventilating adapter according to the present disclosure, viewed from two different perspectives. As shown in FIGS. 3-5B, the ventilating air outlet 110 comprises a top air outlet 111 provided on a top face 101 of the frame 100 of the ventilating fan and a side air outlet 112 provided on a side face 102 of the frame 100 of the ventilating fan which are communicated with each other. The top air outlet 111 and the side air outlet 112 together form the ventilating air outlet 110. In this way, even in a case where the area of the side air outlet 112 is reduced, the total area of the ventilating air outlet 110 can be kept unchanged or can be increased.

The end of the adapter 200 connected with the ventilating air outlet 110 is a fixing section 220, and the other end located downstream of the ventilating air outlet 110 and connected with a conduit is a tail portion 210. As shown in Figures, the fixing section 220 is in a proximate inverted-L shape, which surrounds the periphery of the ventilating air outlet 110 and is fixed to the periphery of the ventilating air outlet 110. As such, the fixing section 220 has a shape adapted for mounting the frame 100, and comprises a horizontal portion 221 enclosing the periphery of the top air outlet 111 and a vertical portion 222 enclosing the periphery of the side air outlet 112. The lower end of the vertical portion 222 is formed with an adapter fixing frame 225. The adapter fixing frame 225 is provided on thereof with protrusion pieces 223 which are inserted into a flange 106 of the frame 100. The upper portion of the vertical portion 222 is provided with a mounting portion 24 configured to fix the fixing section 220 of the adapter 200 to the frame 100.

Since the adapter 200 will be connected with the top air outlet 111 and the side air outlet 112, tight contact between the adapter fixing frame 225 and the frame 100 is critical. Tight contact between faces can be easily realized. However, it is very difficult to realize tight contact between the adapter 200 and a corner portion 104 at which the top face 101 and the side face 102 of the frame 100 intersect. In this embodiment, the protrusion pieces 223 provided on the lower end of the vertical portion 222 and to be inserted into the flange 106 of the frame 100 are first inserted into openings 105 on the flange 106. Then, the vertical portion 222 is fixed to the frame 100 by means of the mounting portion 224 and a screw hole 107 provided on the upper portion of the frame 100. Finally, the adapter fixing frame 225 is fixed on the frame 100 by screws. In this way, the corner portion 104 formed by intersection of the top face 101 provided with the top air outlet 111 and the side face 102 provided with the side air outlet 112 can also tightly contact with the adapter fixing frame 225. Thus, the top air outlet 111 and the side air outlet 112 can tightly connect with the adapter 200 so as to prevent air leakage.

In order that the adapter fixing frame 225 can tightly contact with the frame, the screw hole 107 is preferably provided at an end portion which is outside the side air outlet 112 and in proximity of the side air outlet 112, or at a corner region which is surrounded by the above end portion and a sideline 104.

The upper portion of the fixing section 220 of the adapter 200 including the horizontal portion 221 encloses the top air outlet 111 and is formed with a raised structure 211 gradually inclined upward. The raised structure 211 is formed to be adapted to the airflow blown from the top air outlet 111 to the tail portion 210. The height H1 of the raised structure 211 is less than or equal to the height H2 of the electric element box 300. In this way, during ventilating, the airflow blown out from the fan blades blows to the top air outlet 111 and the side air outlet 112 simultaneously. Since the raised structure 211 forms an inclined face, the inclined face guides the airflow blowing toward the top air outlet 111 to smoothly blow toward the adapter tail portion 210 along the raised structure 211 and then to be discharged to outdoor through the conduit without generating turbulence flow. Since the top face 101 of the frame of the ventilating fan itself is provided thereon with the electric element box 300 and the thickness of the raised structure 211 is substantially the same as the height of the electric element box 300, the thickness of the ventilating fan will not be additionally added. Thus, since the side air outlet 112 becomes smaller, the height of the frame 100 of the ventilating fan can be reduced, i.e., the frame 100 becomes thinner as a whole. Even if a distance between a ceiling and a roof is short, there is enough space for mounting the ventilating fan. Further, since the raised structure is provided to the adapter made of resin material instead of the frame, metal material can be saved.

On the top face 101 of the frame 100, there is provided a reinforcement rib 103 protruding upward from the top face 101 to reinforce the strength of the frame 100 so as to improve safety and durability of products. The reinforcement rib 103 may be in any shape and may be provided at any position on the top face 101 of the frame 100 as long as the performance of the products will not be negatively influenced. For instance, an elongated reinforcement rib 103 is provided on the side of the electric element box 300 close to the adapter 200, and such reinforcement rib 103 reinforces the strength of the top face 101 of the frame 100 without negatively influencing configuration of the elements on the top face of the frame 100.

Figure 6:
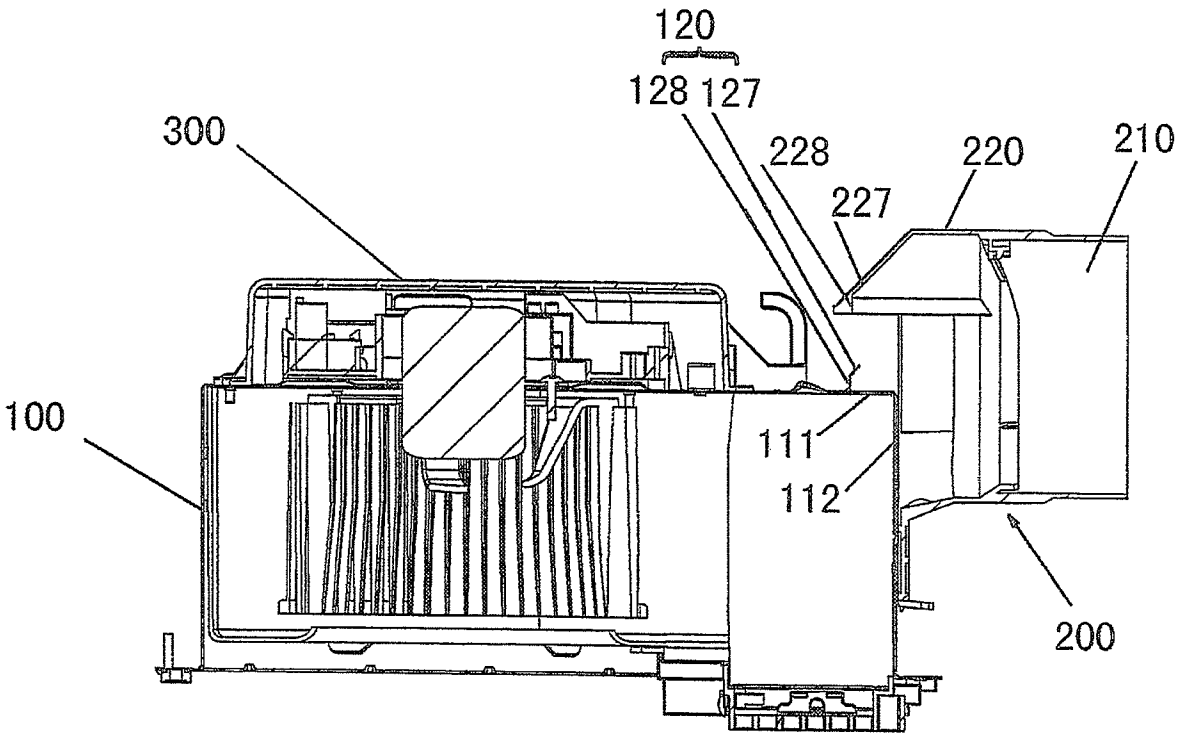
FIG. 6 is a schematic view, in cross-section, of a mounting operation of the ventilating adapter according to the present disclosure.

FIG. 6 is a schematic view, in cross-section, of a mounting operation of the ventilating adapter according to the present disclosure. As shown in the Fig., on the side of the top air outlet 111 close to the electric element box 300, there is provided an engaging structure integrally formed with the frame 100 and engaged with the adapter 200. The engaging structure is a bending piece 120 provided on the side of the top air outlet 111 close to the electric element box 300 and engaged with the adapter 200. The upper end of the bending piece 120 is provided with a first oblique face 127, and the lower end of the bending piece 120 is provided with a first vertical face 128 perpendicular to the frame 100. The adapter fixing section 220 is provided with a structure matching with the bending piece 120 at a position on the adapter fixing section 220 where the adapter fixing section 220 contacts with the bending piece 120, that is, the upper portion of the adapter fixing section 220 is provided at a ventilating air-passageway side of a raised structure 211 thereof (inside the raised structure 211) with a structure, the upper end of which is provided with a second oblique face 227 and the lower end of which is provided with a second vertical face 228 perpendicular to the frame 100. Since the frame 100 is integrally formed with the engaging structure 120, unlike the prior art, no separate engaging structure is needed. The engaging structure 120 is provided on the side of the top air outlet 111 close to the electric element box 300. After the mounting operation of the adapter 200, the top air outlet 111 can be entirely hooded by the adapter 200.

During mounting of the ventilating fan 10 onto the ceiling, the adapter 200 is first fixed to the ceiling by screws. Then, alignment of the ventilating fan 10 from bottom to top is performed, that is, the bending piece 120 integrally formed with the frame 100 is aligned and engaged with the adapter 200. Since the upper end of the bending piece 120 is provided with the first oblique face 127, when the bending piece 120 is engaged into the adapter fixing section 220 from bottom to top, the first oblique face 127 functions to guide the bending piece 120, so that the bending piece 120 can be easily and smoothly engaged into the adapter fixing section 220. In this way, the whole ventilating fan can be mounted and fixed to the ceiling. After mounting, since the lower end of the bending piece 120 is provided with the first vertical face 128 perpendicular to the frame 100 and the lower end of the upper portion of the adapter fixing section 220 is provided with a second vertical face 228 perpendicular to the frame 100, the two vertical faces are fitted to each other, so that the adapter 200 can be prevented from moving outward with respect to the ventilating fan body and hence the adapter 200 can be securely mounted.

What is claimed is:

1. A ventilating fan, comprising:

a ventilating fan body provided with a motor, a frame having ventilating air outlets and fan blades;

an adapter; and an electric element box, wherein the ventilating air outlets comprise a top air outlet provided on a top face of the frame of the ventilating fan and a side air outlet provided on a side face of the frame of the ventilating fan which are communicated with each other, and the adapter is provided with a raised structure adapted to the ventilating air outlets; and wherein an engaging structure integrally formed with the frame and engaged with the adapter is provided at a side of the top air outlet closer to the electric element box, and the engaging structure is a bending piece provided at a side of the top air outlet closer to the electric element box and engaged with the adapter, and the upper end of the bending piece is provided with a first oblique face and the lower end of the bending piece is provided with a first vertical face perpendicular to the top face of the frame, and wherein an upper portion of a fixing section of the adapter is provided at a ventilating air-passageway side of the raised structure thereof with a structure, the upper end of which is provided with a second oblique face and the lower end of which is provided with a second vertical face perpendicular to the top face of the frame, and the second oblique face and the second vertical face fit to the first oblique face and the first vertical face, respectively.

2. The ventilating fan according to claim 1, wherein: the raised structure is formed by enclosing the top air outlet by the upper portion of the fixing section of the adapter and is gradually inclined upward, and the height of the raised structure is less than or equal to the height of the electric element box.

3. The ventilating fan according to claim 1, wherein: the raised structure is made of resin material.

4. The ventilating fan according to claim 1, wherein: the top face of the frame is provided with a reinforcement rib.

5. The ventilating fan according to claim 1, wherein: the fixing section of the adapter has a shape adapted for mounting to the frame, and comprises a horizontal portion enclosing the periphery of the top air outlet and a vertical portion enclosing the periphery of the side air outlet, and the lower end of the vertical portion is provided with protrusion pieces which are inserted into a flange of the frame and the upper portion of the vertical portion is provided with a mounting portion configured to fix the fixing section of the adapter to the frame.

* * * * *